US005427556A

United States Patent [19]

Ishikawa et al.

[11] Patent Number: 5,427,556

[45] Date of Patent: Jun. 27, 1995

[54] POWER STEERING DEVICE FOR BOAT PROPULSION UNIT

[75] Inventors: Kenji Ishikawa; Yasuo Funami; Yoshimi Watanabe, all of Saitama, Japan

[73] Assignee: Showa Corporation, Saitama, Japan

[21] Appl. No.: 118,306

[22] Filed: Sep. 9, 1993

[30] Foreign Application Priority Data

Sep. 10, 1992 [JP] Japan ..... 4-268133

[51] Int. Cl.[6] ..... B63H 5/12

[52] U.S. Cl. ..... 440/62; 114/150

[58] Field of Search ..... 137/625.21, 625.23; 91/375 R, 383; 251/304, 294; 440/53, 61, 62; 114/144 R, 150

[56] References Cited

U.S. PATENT DOCUMENTS

| | | | |
|---|---|---|---|
| 2,271,331 | 1/1942 | Eliott | 137/625.21 |
| 3,297,052 | 1/1967 | Robinson | 137/625.21 |
| 3,358,564 | 12/1967 | Peterson | 91/383 |
| 4,325,447 | 4/1982 | Dauvergne | 137/625.21 |
| 4,976,639 | 12/1990 | Rawlings et al. | 440/59 |

FOREIGN PATENT DOCUMENTS 2-147497 2/1990 Japan .

*Primary Examiner*—Edwin L. Swinehart
*Attorney, Agent, or Firm*—Howard L. Rose

[57] ABSTRACT

A power steering device for use with a boat propulsion unit has a hydraulic cylinder unit for angularly moving a steering arm of the boat propulsion unit. A rotary valve mechanism for supplying working oil from a working oil tank to the hydraulic cylinder unit and discharging working oil from the hydraulic cylinder unit to the working oil tank comprises a flat valve body having oil holes defined transversely therethrough and a valve housing assembly housing the flat valve body and having ports defined therein for communication with the oil holes, the ports being connected to the working oil tank and the hydraulic cylinder unit. The power steering device also includes a steering shaft for operating the rotary valve mechanism in response to a steering action. The hydraulic cylinder unit, the rotary valve mechanism, and the steering shaft are integrally joined to each other.

3 Claims, 9 Drawing Sheets

POWER STEERING DEVICE FOR BOAT PROPULSION UNIT

BACKGROUND OF THE INVENTION

1. Field of the Invention

The present invention relates to a power steering device for steering a boat propulsion unit with a hydraulic cylinder unit which is connected in ganged relationship to a steering wheel.

2. Description of the Prior Art

One conventional power steering device for steering a boat propulsion unit is disclosed in Japanese laid-open patent publication No. 2-147497, which corresponds to U.S. Pat. No. 4,976,639. The disclosed power steering device has a cable assembly coupled to and extending from a steering wheel, the cable assembly comprising a sheath and a core inserted therein. The core is fixed to a bracket on a distal end of the piston rod of a hydraulic cylinder unit which angularly moves the boat propulsion unit in a horizontal direction. The sheath is attached to a steering tube which can be moved in response to operation of the steering wheel. When the steering tube is moved by the steering wheel, the movement of the steering tube is transmitted through a gear or a lever to a spool valve, which delivers working oil from a pump to a left (upper) chamber or a right (lower) chamber of the hydraulic cylinder unit, thus moving the piston rod. When the piston rod is thus moved, a steering arm coupled thereto is angularly moved thereby steering the boat propulsion unit.

In the disclosed power steering device, the steering tube, the spool valve, and the rod of the hydraulic cylinder unit have respective axes lying parallel to each other in order to achieve a simple assembly for transmitting the movement of the cable assembly to the hydraulic cylinder unit. Therefore, the steering tube, the spool valve, and the hydraulic cylinder unit are required to be installed highly accurately in place relative each other. Because of the high assembling accuracy required, the conventional power steering device is manufactured relatively expensively in a relatively complex process.

SUMMARY OF THE INVENTION

It is an object of the present invention to provide a power steering device for steering a boat propulsion unit, which is of a relatively simple arrangement capable of reliably and stably steering the boat propulsion unit with relatively small manual steering forces.

According to the present invention, there is provided a power steering device for use with a boat propulsion unit, comprising a hydraulic cylinder unit for angularly moving a steering arm of the boat propulsion unit, a working oil tank, a rotary valve mechanism for supplying working oil from the working oil tank to the hydraulic cylinder unit and discharging working oil from the hydraulic cylinder unit to the working oil tank, the rotary valve mechanism comprising a flat valve body having oil holes defined transversely therethrough and a valve housing assembly housing the flat valve body and having ports defined therein for communication with the oil holes, the ports being connected to the working oil tank and the hydraulic cylinder unit, and a steering shaft for operating the rotary valve mechanism in response to a steering action, the hydraulic cylinder unit, the rotary valve mechanism, and the steering shaft being integrally joined to each other.

According to the present invention, there is also provided a power steering device for use with a boat propulsion unit, comprising a working oil supply, a hydraulic cylinder unit for angularly moving the boat propulsion unit under the pressure of working oil supplied from the working oil supply, a steering shaft axially movable in response to a manual steering action, a rotary valve mechanism for supplying working oil from the working oil supply to the hydraulic cylinder unit and discharging working oil from the hydraulic cylinder unit to the working oil supply, the rotary valve mechanism having a rotatable valve body for controlling a working oil flow between the working oil supply and the hydraulic cylinder unit, the steering shaft being coupled to the valve body at an off-center position thereon.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
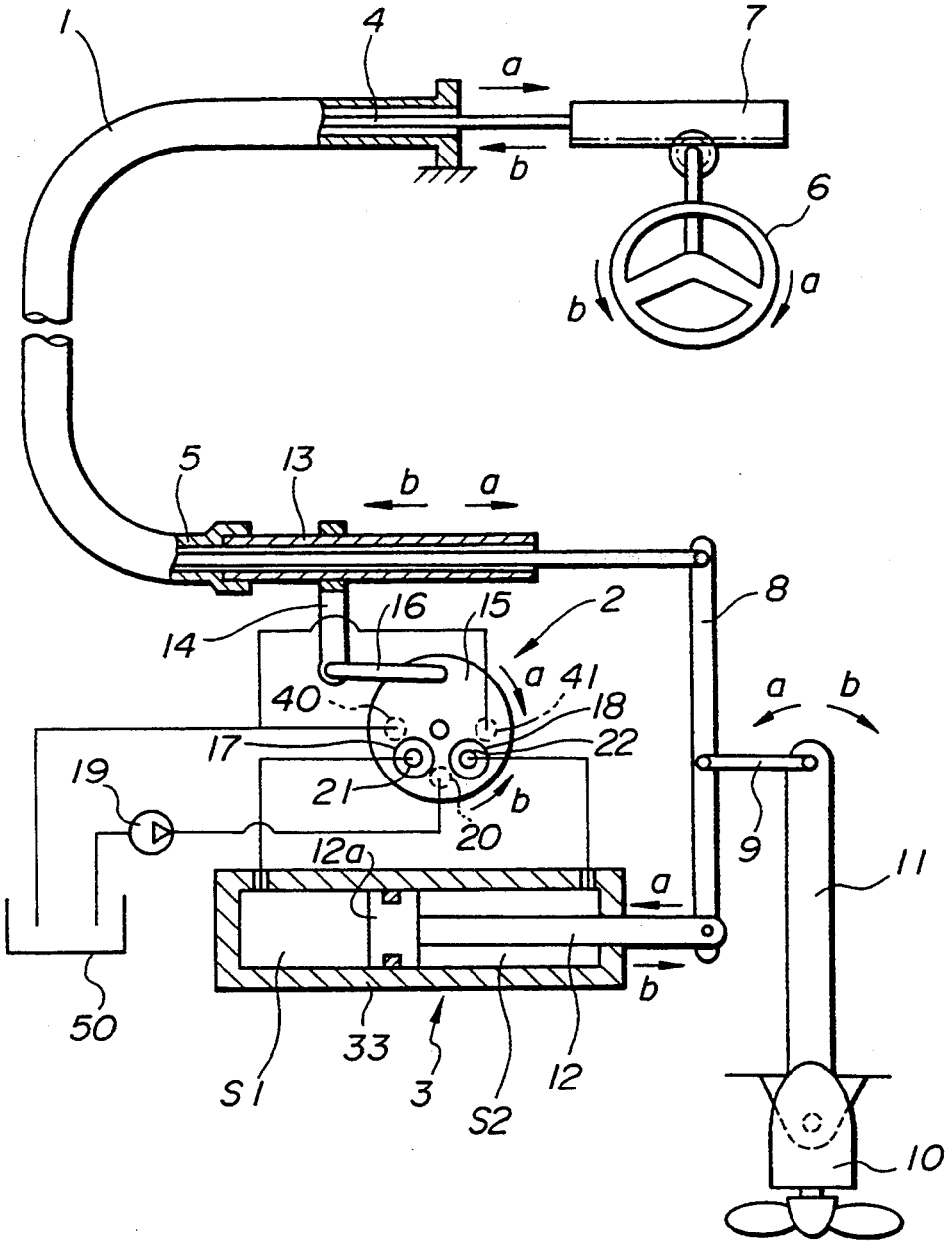
FIG. 1 is a schematic view, partly in cross section, of a power steering device for a boat propulsion unit according to the present invention.

As shown in FIG. 1, a power steering device for a boat propulsion unit according to the present invention generally comprises a cable assembly 1, a rotary valve mechanism 2, and a hydraulic cylinder unit 3.

The cable assembly 1 comprises a core 4 and a sheath 5 encasing the core 4. The core 4 has one end coupled to a rack 7 that is axially movable back and forth in response to operation of a steering wheel 6 of a boat (not shown). The other end of the core 4 is coupled to one end of a clevis 8. The clevis 8 has its intermediate portion connected through a link 9 to a swing arm 11 of a boat propulsion unit 10 which is angularly movably mounted on the stern of the boat. The other end of the clevis 8 is coupled to a distal end of an axially movable piston rod 12 of the hydraulic cylinder unit 3. The sheath 5 has one end fastened to the hull of the boat and the other end to one end of a steering shaft 13.

The hydraulic cylinder unit 3 has a cylinder 33 whose interior space is divided into a left chamber S1 and a right chamber S2 by a piston 12*a* slidably disposed in the cylinder 3*a* and joined to the inner end of the piston rod 12.

To the steering shaft 13, there is attached a connecting rod 14 extending perpendicularly thereto and having an end coupled by a pusher rod 16 to a flat circular valve body 15 of the rotary valve mechanism 2 at an off-center position.

The valve body 15 has a pair of circular oil holes 17, 18 defined transversely therethrough. The rotary valve mechanism 2 includes housings (described later on) having a supply port 20 for introducing working oil from a tank 50 through a pump 19 and a pair of supply ports 21, 22 for supplying working oil into the left and right chambers S1, S2, respectively, of the hydraulic cylinder unit 3.

When the steering wheel 6 is turned clockwise in the direction indicated by the arrow a, the core 4 is pulled in the direction a. Since the core 4 is fixed to the clevis 8, any flexing of the core 4 is small. The sheath 5 and the steering shaft 13 coupled thereto are now moved in the direction a, causing the valve body 15 to rotate clockwise in the direction a. The supply ports 20, 22 are brought into communication with each other through the oil hole 18, supplying working oil from the pump 19 into the right chamber S2 of the hydraulic cylinder unit 3. The piston rod 12 is axially moved in the direction a, enabling the clevis 8 and the link 9 to swing the swing arm 11 counterclockwise in the direction a. Therefore, the boat propulsion unit 10 is turned counterclockwise, steering the boat to the right.

When the steering wheel 6 is turned counter-clockwise in the direction indicated by the arrow b, the core 4 is pushed in the direction b, the sheath 5 and the steering shaft 13 to move in the direction b. The valve body 15 is rotated counterclockwise in the direction b. The supply ports 20, 21 are brought into communication with each other through the oil hole 17, supplying working oil from the pump 19 into the left chamber S1 of the hydraulic cylinder unit 3. The piston rod 12 is axially moved in the direction b, enabling the clevis 8 and the link 9 to swing the swing arm 11 clockwise in the direction b. Therefore, the boat propulsion unit 10 is turned clockwise, steering the boat to the left.

The rotary valve mechanism 2, the hydraulic cylinder unit 3, and the steering shaft 13 are unitized as an integral assembly. The integral assembly will be described below with reference to FIGS. 2 through 11.

Figure 2:
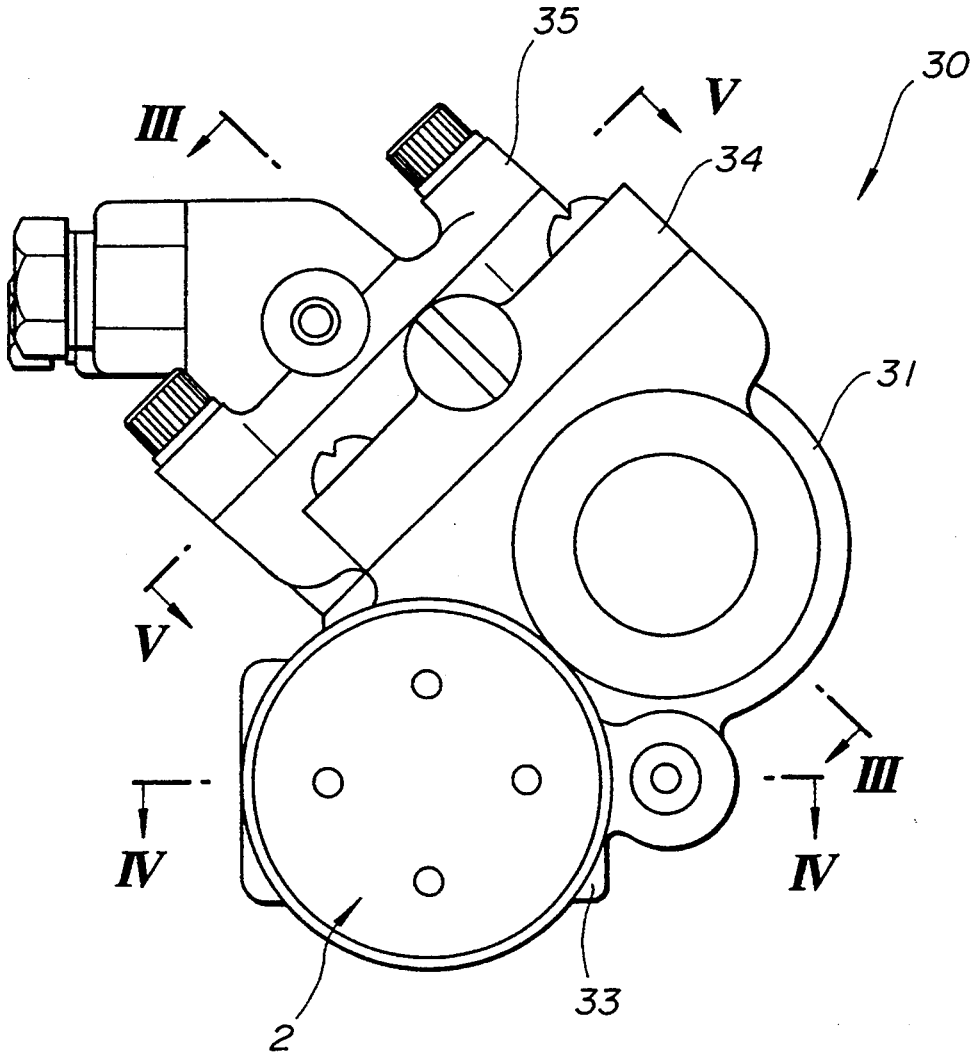
FIG. 2 is an end elevational view of an assembly of the power steering device.
Figure 3:
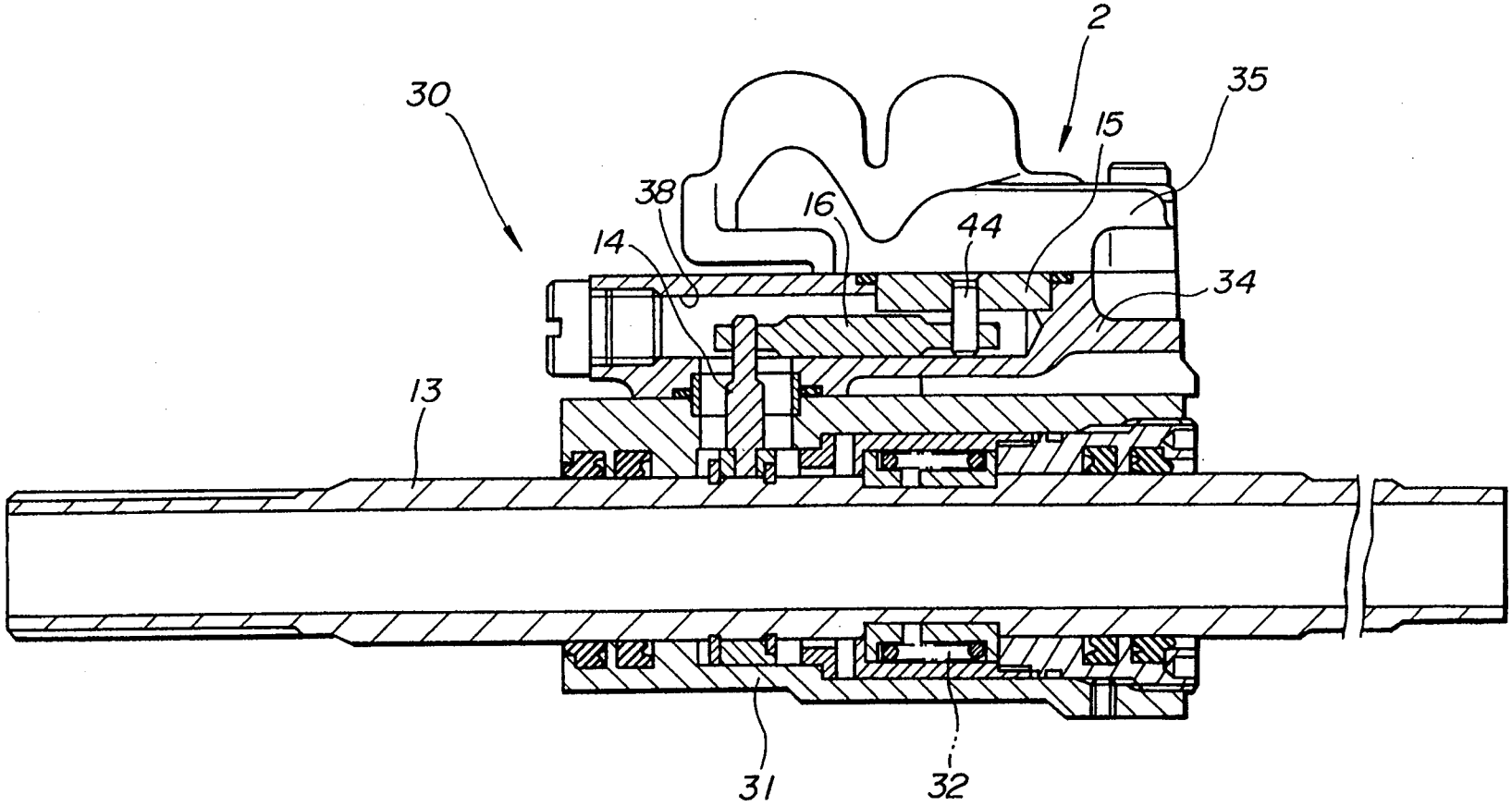
FIG. 3 is a cross-sectional view taken along line III—III of FIG. 2.

As shown in FIGS. 2 and 3, the integral assembly, generally designated by the reference numeral 30, includes a holder 31 through which the steering shaft 13 is slidably inserted. A return spring 32 (see FIG. 3) for returning the steering shaft 13 to a neutral position is disposed in the holder 31 around the steering shaft 13.

Figure 4:
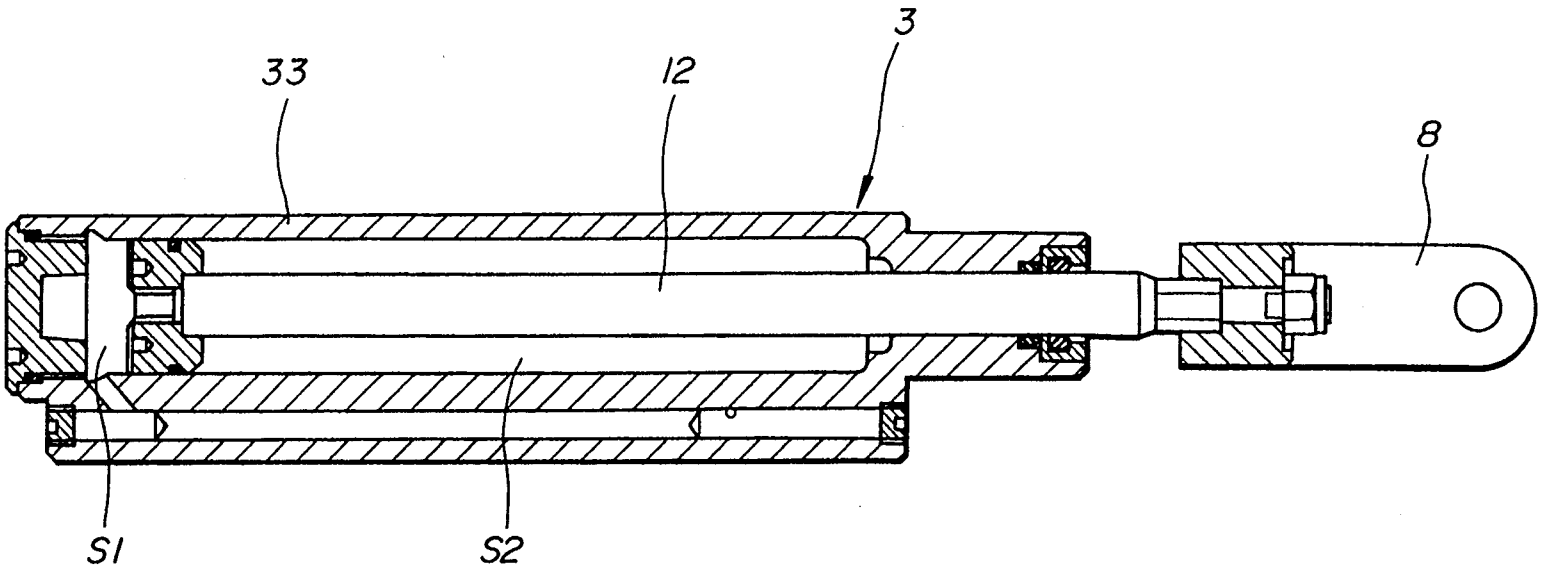
FIG. 4 is a cross-sectional view taken along line IV—IV of FIG. 2.
Figure 5:
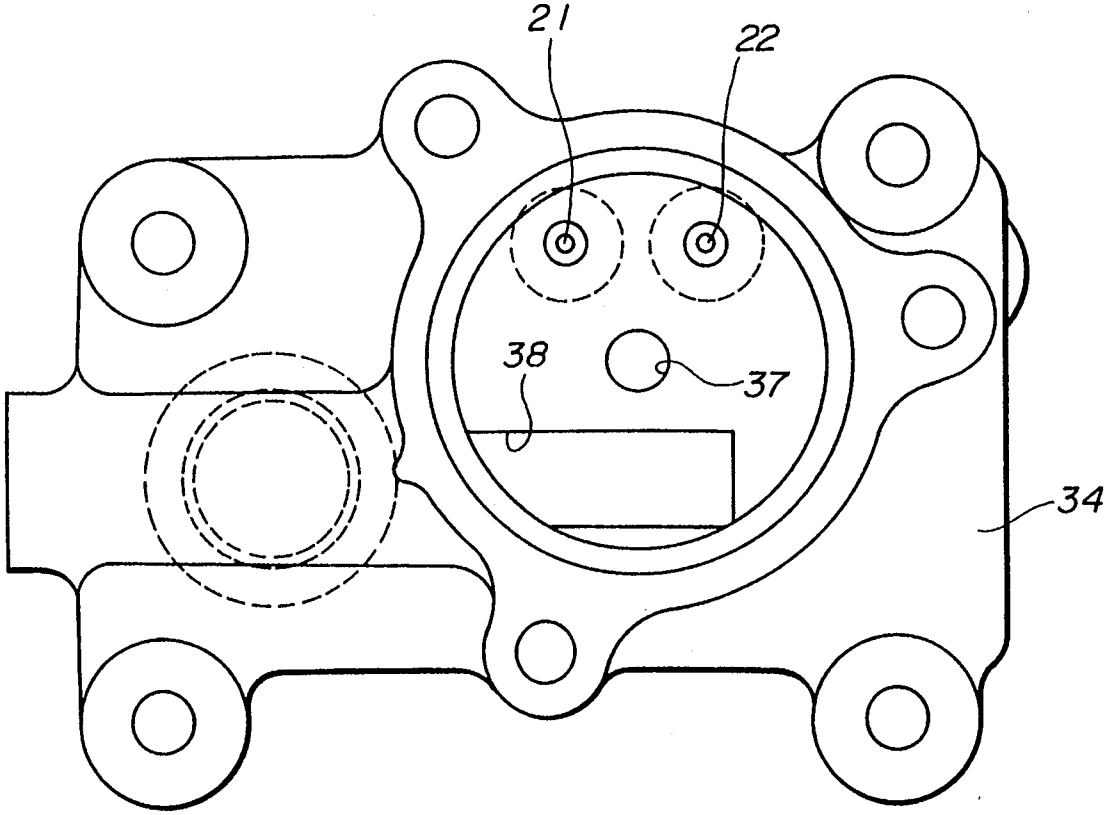
FIG. 5 is a cross-sectional view taken along line V—V of FIG. 2.

The cylinder 33, which may be integrally cast with the holder 31 or separate from the holder 31, is joined to the holder 31, and the piston rod 12 is inserted in the cylinder 33 parallel to the steering shaft 13, as shown in FIG. 4.

Figure 7:
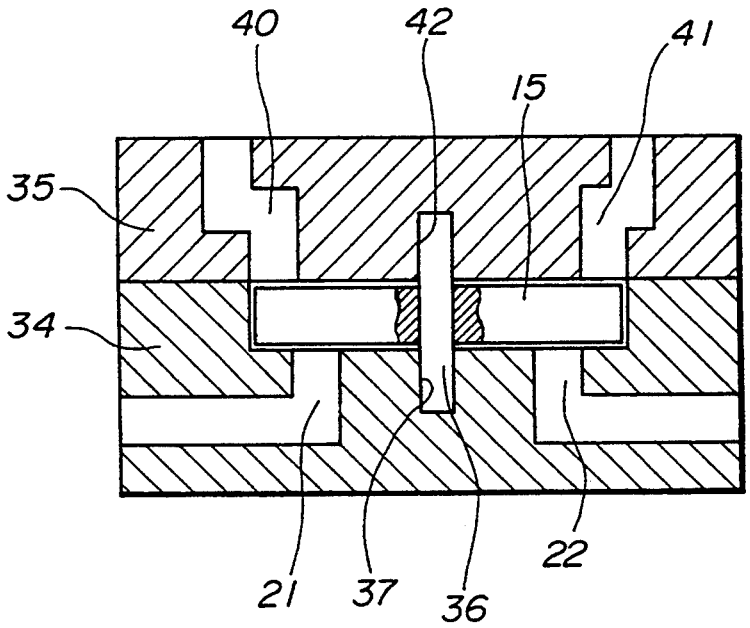
FIG. 7 is an axial cross-sectional view of the rotary valve.
Figure 8:
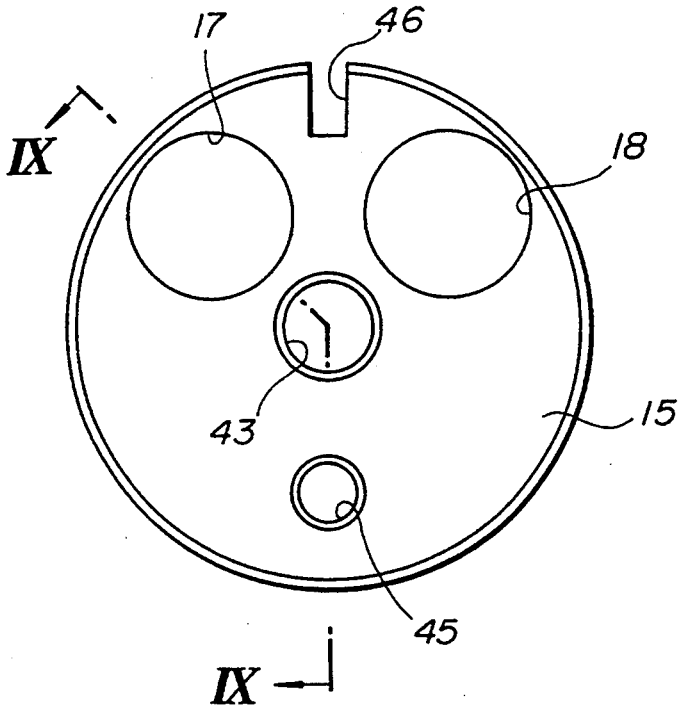
FIG. 8 is a plan view of a valve body of the rotary valve.
Figure 9:
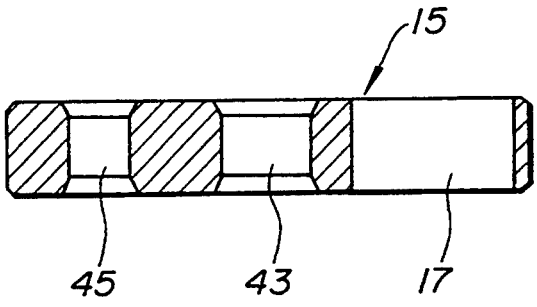
FIG. 9 is a cross-sectional view taken along line IX—IX of FIG. 8.

As shown in FIGS. 2 and 3, the rotary valve mechanism 2 has a rotor housing 34 fixed to the holder 31, and a port housing 35 attached to the rotor housing 34. As shown in FIG. 7, the valve body 15 is rotatably disposed in the rotor housing 34 and supported on a shaft 36 for rotation therearound. The rotor housing 34 has a hole 37 in which one end of the shaft 36 is fitted, the support ports 21, 22 (see also FIG. 5), and a groove 38 (see FIG. 3) in which the pusher rod 16 is disposed.

Figure 6:
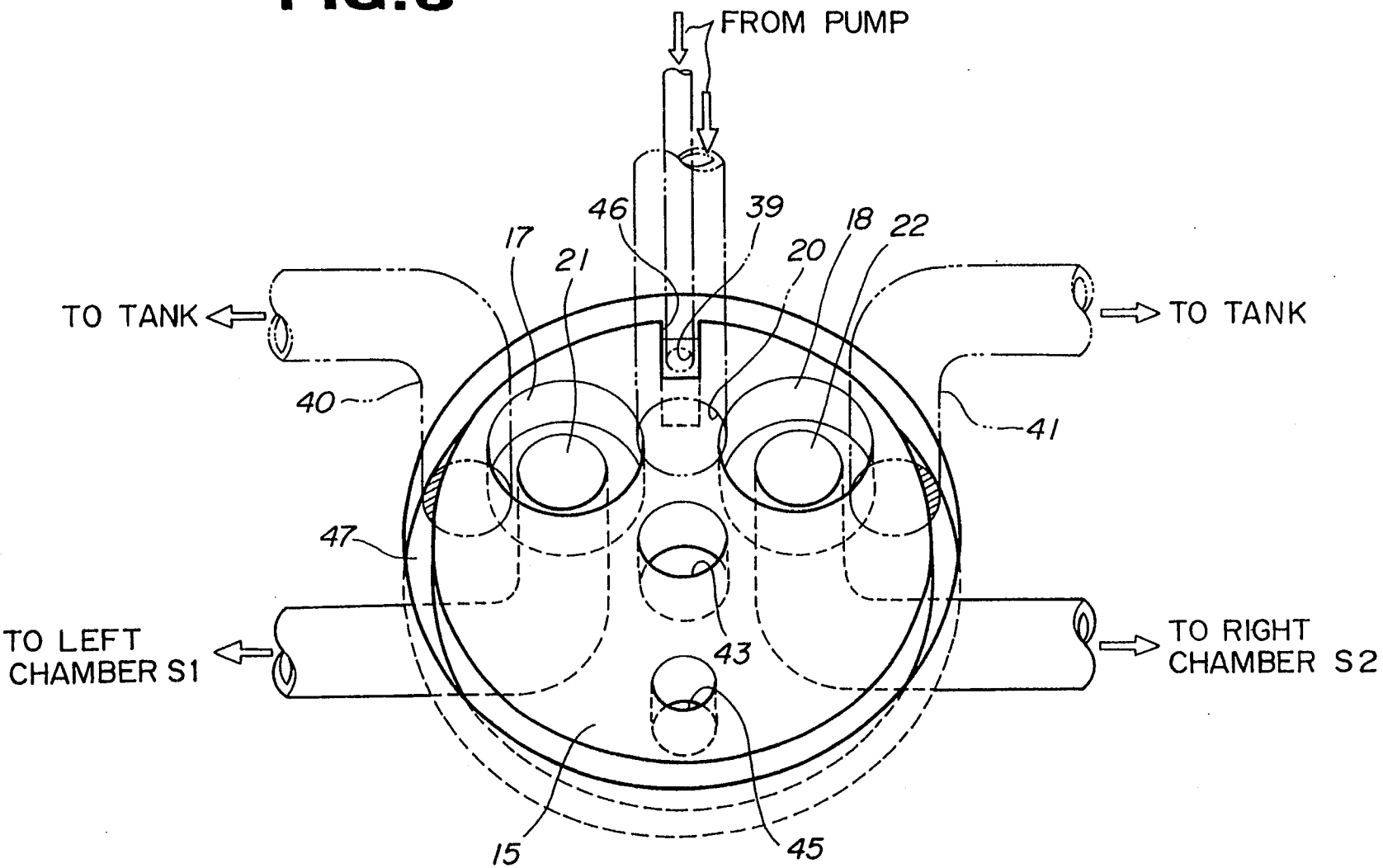
FIG. 6 is a perspective view of a rotary valve of the power steering device.

As shown in FIG. 6, the port housing 35 has the supply port 20, an auxiliary supply port 39 connected to the pump 19, a pair of return ports 40, 41 for returning working oil to the tank 50, and a hole 42 (see FIG. 7) in which the shaft 36 is fitted.

The valve body 15 has the oil holes 17, 18 (see FIGS. 8 and 9), a central hole 43 through which the shaft 36 extends, an off-center hole 45 in which the pusher rod 16 engages, and a recess 46 defined transversely therethrough in an outer circumferential edge thereof. When the valve body 15 is in a neutral position shown in FIG. 6, the recess 46 communicates with the auxiliary supply port 39.

The valve body 15 has an outside diameter smaller than the inside diameter of the rotor housing 34. Therefore, when the valve body 15 is mounted in the rotor housing 34, there is created a relatively large annular gap or clearance 47 between the outer circumferential edge of the valve body 15 and the inner circumferential edge of the rotor housing 34. The recess 46 of the valve body 15 also communicates with the gap 47. The return ports 40, 41 have respective portions (shown hatched in FIG. 6) opening into the gap 47. When the valve body 15 is in the neutral position shown in FIG. 6, therefore, working oil circulates at a sufficient rate from the tank 50 through the pump 19, the auxiliary supply port 39, the recess 46, the gap 47, and the return ports 40, 41 to the tank 50. At this time, working oil also circulates from the supply port 20 through the oil holes 17, 18 to the return ports 40, 41 through gaps existing therebetween. However, if those gaps were large enough to produce sufficient working oil circulation from the supply port 20 through the oil holes 17, 18 to the return ports 40, 41, then the rotary valve mechanism 2 would not have a desired flow control function, and hence the power steering device would not provide a stable power steering performance. Stated otherwise, instead of achieving sufficient working oil circulation through the gaps between the supply port 20, the oil holes 17, 18, and the return ports 40, 41, the oil flow passage from the tank 50 through the pump 19, the auxiliary supply port 39, the recess 46, the gap 47, and the return ports 40, 41 to the tank 50 is provided to circulate workpiece oil when the valve body 15 is in the neutral position sufficient to generate the mechanism when the valve is moved off of the neutral position.

Figure 10:
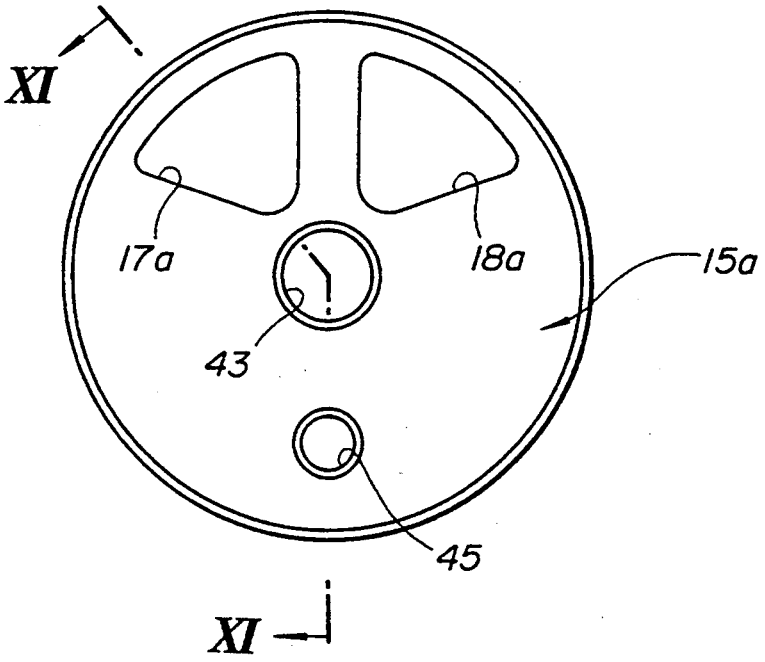
FIG. 10 is a plan view of a valve body of a rotary valve according to another embodiment of the present invention.
Figure 11:
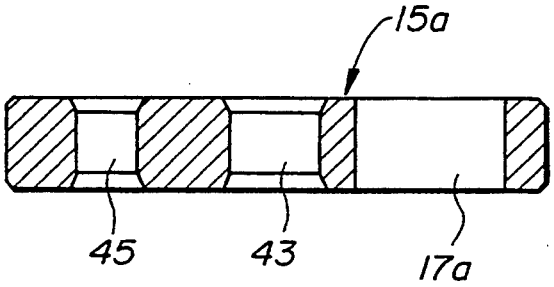
FIG. 11 is a cross-sectional view taken along line XI—XI of FIG. 10.

FIGS. 10 and 11 illustrate a valve body 15*a* according to another embodiment of the present invention. The valve body 15*a* has a pair of substantially triangular oil holes 17*a*, 18*a* defined therein and does not have a recess corresponding to the recess 46 shown in FIG. 6. The outside diameter of the valve body 15*a* is substantially the same as the inside diameter of the rotor housing 34, so that no large gap or clearance is defined between the valve body 15*a* and the rotor housing 34. When the valve body 15*a* is in the neutral position, circulating working oil flows through the oil holes 17*a*, 18*a* and the return ports 40, 41 to the tank 50.

As described above, the rotary valve mechanism 2 is employed, rather than a spool valve, for supplying working oil to and discharging working oil from the hydraulic cylinder unit 3. The rotary valve mechanism 2 is advantageous in that its friction is relatively small and can be well sealed.

Since the connecting rod 14 and hence the steering shaft 13 are coupled to the valve body 15 through the pusher rod 16 at an off-center position on the valve body 15, the valve body 15 can be rotated through a required angular displacement by a reduced movement of the steering shaft 13 and hence the cable assembly 1. Such a reduced movement of the steering shaft 13 results in a reduced elastic deformation of the return spring 32, allowing the steering wheel 6 to be turned with reduced manual forces.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A power steering device for use with a boat propulsion unit, comprising:

a hydraulic cylinder unit for angularly moving a steering arm of the boat propulsion unit;

a tank for working oil;

a rotary valve mechanism for supplying working oil from said working oil tank to said hydraulic cylinder unit and discharging working oil from said hydraulic cylinder unit to said tank, said rotary valve mechanism comprising a flat valve body having oil holes defines transversely therethrough and a valve housing assembly housing said flat valve body and having ports defined therein for communication with said oil holes, said ports being connected to said tank and said hydraulic cylinder unit;

a steering shaft for operating said rotary valve mechanism in response to a steering action; and a connecting rod attached to said steering shaft, and a pusher rod interconnecting said connecting rod and said valve body at an off-center position on the valve body;

said hydraulic cylinder unit, said rotary valve mechanism, and said steering shaft being integrally joined to each other.

2. A power steering device according to claim 1, wherein said rotary valve mechanism has an annular gap defined radially between said valve body and said housing assembly, said housing assembly having ports connected to said tank and opening into said annular gap.

3. A power steering device according to claim 1, wherein each of said oil holes is substantially triangular in shape, said housing assembly having ports connected to said tank and opening into the substantially triangular oil holes.

* * * * *